US008840416B2

(12) United States Patent
Huang

(10) Patent No.: US 8,840,416 B2
(45) Date of Patent: Sep. 23, 2014

(54) PORTABLE ELECTRONIC DEVICE

(71) Applicants: Inventec (Pudong) Technology Corporation, Shanghai (CN); Inventec Corporation, Taipei (TW)

(72) Inventor: Cheng-Chin Huang, Taipei (TW)

(73) Assignees: Inventec (Pudong) Technology Corporation, Shanghai (CN); Inventec Corporation, Taipei (TW)

( * ) Notice: Subject to any disclaimer, the term of this patent is extended or adjusted under 35 U.S.C. 154(b) by 41 days.

(21) Appl. No.: 13/798,492

(22) Filed: Mar. 13, 2013

(65) Prior Publication Data

US 2014/0106584 A1 Apr. 17, 2014

(30) Foreign Application Priority Data

Oct. 15, 2012 (CN) ..... 2012 1 0390371

(51) Int. Cl.
*H01R 4/50* (2006.01)
*H01R 13/453* (2006.01)
*H01R 24/64* (2011.01)

(52) U.S. Cl.
CPC ..... *H01R 13/4532* (2013.01); *H01R 2201/04* (2013.01); *H01R 2201/06* (2013.01); *H01R 24/64* (2013.01)
USPC ..... 439/344

(58) Field of Classification Search
USPC ..... 439/344, 144, 676, 131
See application file for complete search history.

(56) References Cited

U.S. PATENT DOCUMENTS

| | | | | |
|---|---|---|---|---|
| 5,562,504 | A * | 10/1996 | Moshayedi | 439/638 |
| 5,679,013 | A * | 10/1997 | Matsunaga et al. | 439/144 |
| 5,692,914 | A * | 12/1997 | Mitani et al. | 439/131 |
| 6,155,882 | A * | 12/2000 | Wu | 439/676 |
| 7,074,061 | B1 * | 7/2006 | Roth et al. | 439/131 |
| 7,458,830 | B2 * | 12/2008 | Reid et al. | 439/131 |
| 8,079,967 | B2 * | 12/2011 | Ikeuchi et al. | 601/5 |
| 2012/0015535 | A1 * | 1/2012 | Lin et al. | 439/136 |

* cited by examiner

*Primary Examiner* — Phuong Dinh
(74) *Attorney, Agent, or Firm* — Morris Manning & Martin LLP; Tim Tingkang Xia, Esq.

(57) ABSTRACT

A portable electronic device, for inserting and connecting an electrical connector, includes a housing assembly, an electrical socket disposed in the housing assembly and having a slot, a cover plate and an elastic member. The slot is used for inserting and connecting the electrical connector. The cover plate is pivotally connected to the second casing, and is adapted to pivot relative to the housing assembly between a first position and a second position. When the cover plate is at the second position, the cover plate and the housing assembly form an opening. When the cover plate is at the first position, the cover plate covers a part of the area of the opening and shields a part of the electrical socket. The elastic member is connected to both the second casing and the cover plate, and makes the cover plate to be located in the first position.

10 Claims, 7 Drawing Sheets

PORTABLE ELECTRONIC DEVICE

CROSS-REFERENCE TO RELATED APPLICATIONS

This non-provisional application claims priority under 35 U.S.C. §119(a) on Patent Application No(s). 201210390371.6 filed in China on Oct. 15, 2012, the entire contents of which are hereby incorporated by reference.

BACKGROUND

1. Technical Field

The disclosure relates to a portable electronic device, and more particularly to a portable electronic device having a pivot shaft.

2. Related Art

The rapid development of the electronic industry and information industry brings about an increasingly higher innovation speed of electronic products. In order to attract the attention of consumers, manufacturers start emphasizing the exterior of electronic products, as well as the electronic products. When it comes to laptop computers, in order to enable them to compete with other portable electronic devices, various manufacturers successively develop slim computers with a streamlined appearance, hoping to attract buyers through the portability and the exterior of the slim laptop computers.

The slim laptop computer is generally equipped with multiple electronic slots for inserting into and connecting to an external electronic device or a network line, and multiple corresponding openings are provided on the housing of the slim laptop computer, so that the external electronic device can be connected to the notebook computer. However, if the openings are designed inappropriately, the exterior of the slim laptop computer will be affected, thereby reducing the willingness of consumption of the consumers. Therefore, how to design electronic slots and openings having both the extension performance and exterior on the slim laptop computer is a problem to be solved by designers.

SUMMARY

This disclosure provides a portable electronic device, for inserting and connecting an electrical connector, comprising a housing assembly, an electrical socket, a cover plate and an elastic member. The electrical socket is disposed in the housing assembly. The electrical socket has a slot. The slot is used for inserting and connecting the electrical connector. The cover plate is pivotally connected to the housing assembly. The cover plate is adapted to pivot relative to the housing assembly between a first position and a second position. When the cover plate is located in the second position, the cover plate and the housing assembly form an opening. The opening is in direct connection with the slot. When the cover plate is located in the first position, the cover plate covers a part of the area of the opening and shields a part of the electrical socket. The elastic member has one end connected to the housing assembly and the other end connected to the cover plate. The elastic member is adapted to make the cover plate to be located in the first position in a normal state. When the cover plate is pressed by the electrical connector, the cover plate pivots to the second position, so as to allow the electrical connector to be inserted into the slot. When the electrical connector is exited by the slot, the cover plate is pushed by the elastic member to pivot to the first position.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

The detailed features and advantages of the disclosure are described below in great detail through the following embodiments, the content of the detailed description is sufficient for those skilled in the art to understand the technical content of the present disclosure and to implement the disclosure there accordingly. Based upon the content of the specification, the claims, and the drawings, those skilled in the art can easily understand the relevant objectives and advantages of the disclosure.

Figure 1:
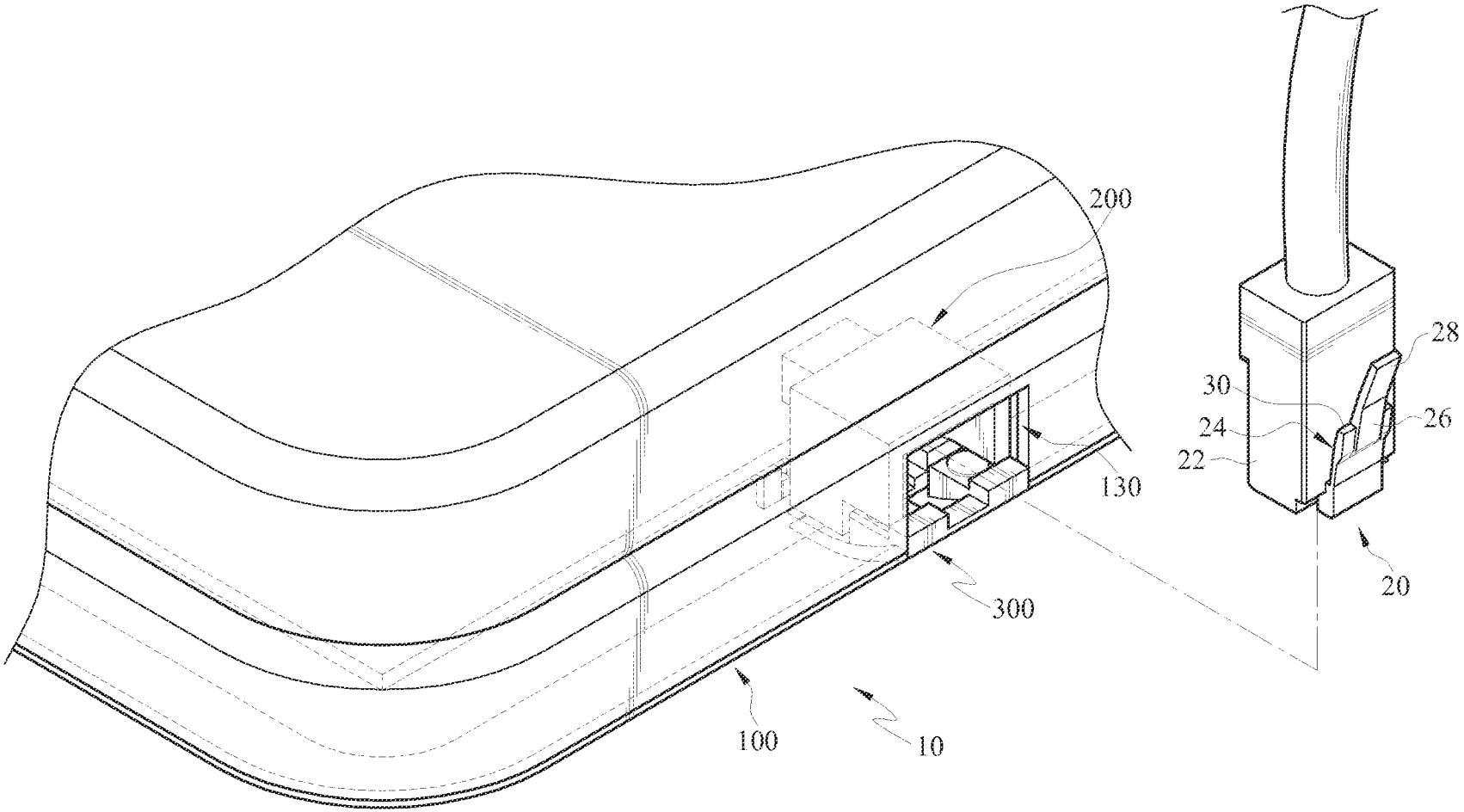
FIG. 1 is a schematic three-dimensional view of a portable electronic device according to an embodiment of the disclosure.
Figure 2A:
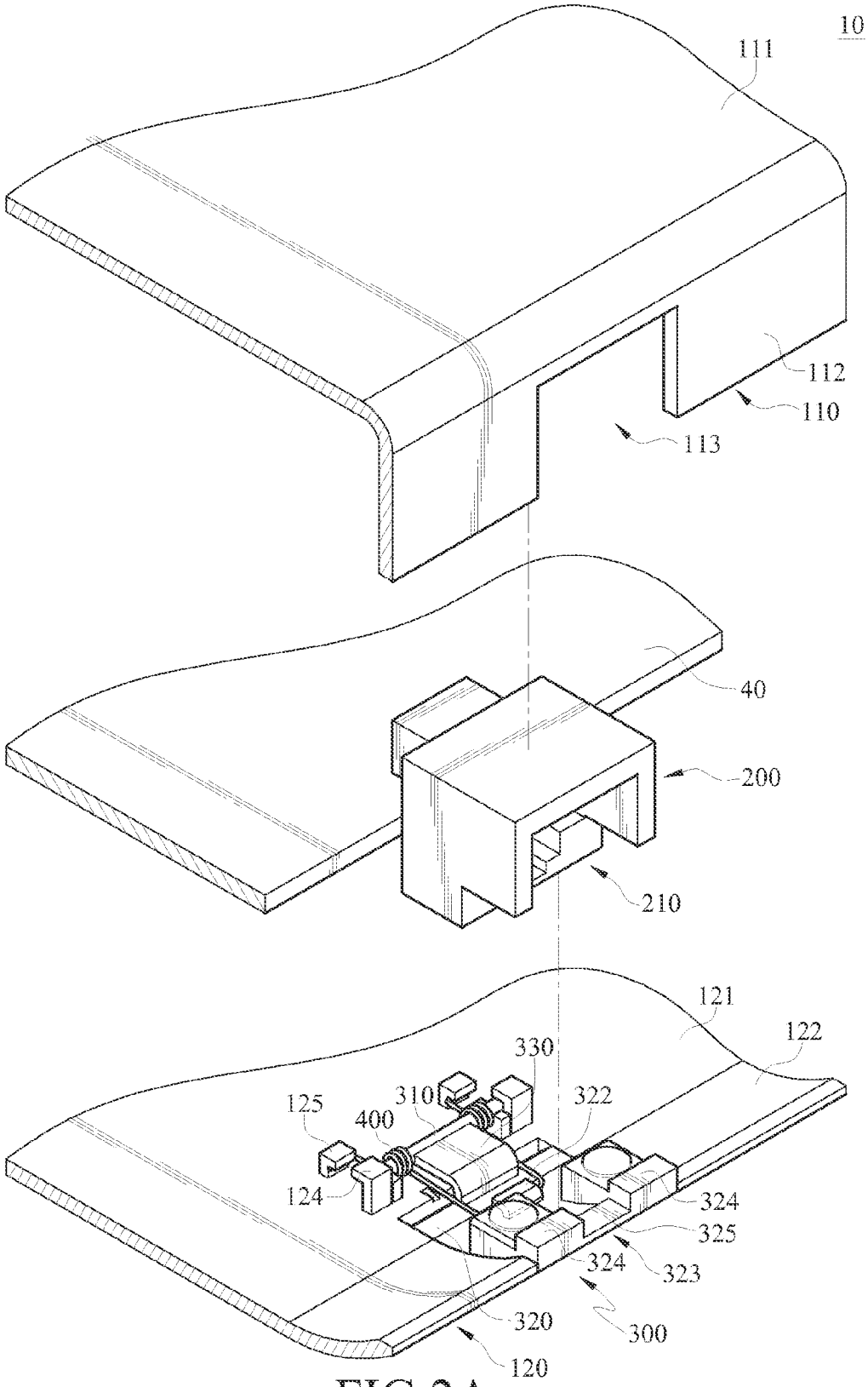
FIG. 2A is a schematic exploded view of FIG. 1.
Figure 2B:
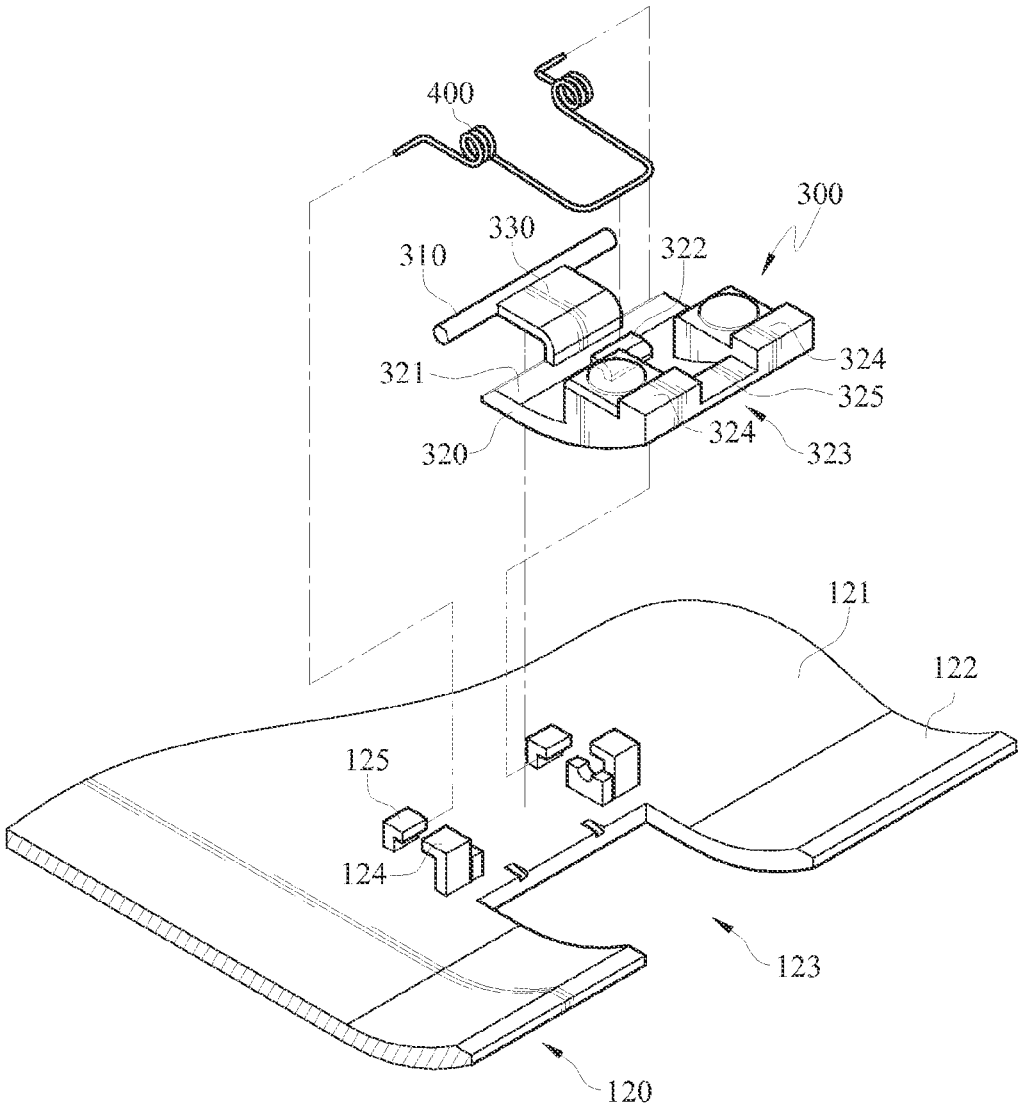
FIG. 2B is a schematic exploded view of FIG. 1.
Figure 3:
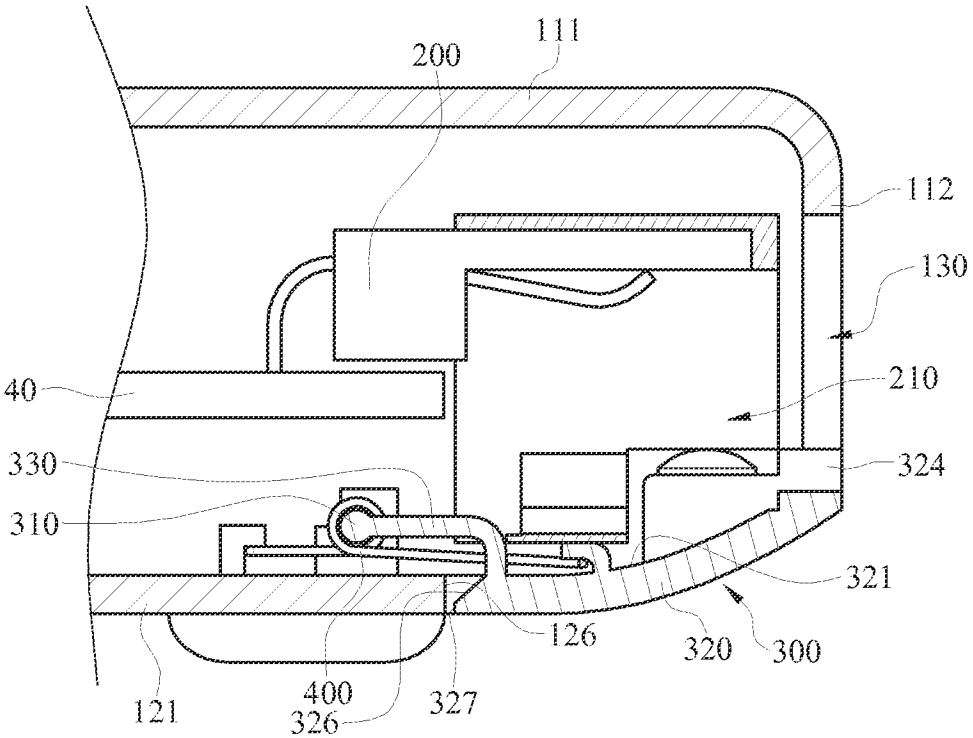
FIG. 3 is a schematic sectional view of FIG. 1.

Referring to FIGS. 1 to 3, FIG. 1 is a schematic three-dimensional view of a portable electronic device according to an embodiment of the disclosure, FIG. 2A is a schematic exploded view of FIG. 1, FIG. 2B is a schematic exploded view of FIG. 1, and FIG. 3 is a schematic sectional view of FIG. 1.

A portable electronic device 10 in this embodiment is designed to be applicable to a slim laptop computer, but not limited to the disclosure. In other embodiments, the portable electronic device 10 is applicable to electronic devices such as a laptop computer with a common thickness, a tablet computer, and a desktop computer. Moreover, the portable electronic device 10 is used for inserting into and connecting to an electrical connector 20, so that external data may be transmitted to the laptop computer through the electrical connector 20 and the portable electronic device 10. The electrical connector 20 comprises a connecting body 22 and an elastic piece 24. The elastic piece 24 has a fastening section 26 and a releasing section 28. The fastening section 26 and the releasing section 28 are connected to each other. The fastening section 26 is connected to the connecting body 22, and one side of the fastening section 26 has two fastening surfaces 30. The releasing section 28 is located between the two fastening surfaces 30.

The portable electronic device 10 of this embodiment comprises a housing assembly 100, an electrical socket 200, a cover plate 300 and an elastic member 400.

The housing assembly 100 is a part of the housing of the slim laptop computer. The housing assembly 100 comprises a first casing 110 and a second casing 120. The first casing 110 is mounted on the second casing 120. The cover plate 300 is pivotally connected to the housing assembly 100. The cover plate 300 pivots relative to the housing assembly 100 between a first position and a second position. When the cover plate 300 is located in the second position, the cover plate 300 and the housing assembly 100 form an opening 130 together. When the cover plate 300 is located in the first position, the cover plate covers a part of the area of the opening and shields a part of the electrical socket 200.

In this embodiment, the first casing 110 is mounted on the second casing 120. The first casing 110 has a first notch 113. The second casing 120 has a second notch 123. The cover plate 300 is pivotally connected to the second casing 120, and located at the second notch 123. When the cover plate 300 is located in the second position, the cover plate and the first casing form the opening together, and when the cover plate is located in the first position, the cover plate covers a part of the area of the opening as well as exposing a part of the second notch.

Moreover, the first casing 110 comprises a top plate 111 and a side plate 112. The side plate 112 is connected to one side of the top plate 111. In this embodiment, the side plate 112 has the first notch 113. The second casing 120 comprises a bottom plate 121 and an extension plate 122. The extension plate 122 is connected to one side of the bottom plate 121. In this embodiment, the bottom plate 121 and the extension plate 122 together form the second notch. The bottom plate 121 of the second casing 120 has a surface 126 which forms a part of the second notch 123. The surface 126 faces the top plate 111. However, this disclosure is not limited thereto, and in other embodiments, the second notch 123 is formed by the extension plate 122, and the surface 126 is located on the extension plate 122. When the first casing 110 is mounted on the second casing 120, the side plate 112 and the extension plate 122 are pressed against each other. Moreover, the bottom plate 121 comprises a pivot seat 124 and a first pressing portion 125. The pivot seat 124 is closer to the cover plate 300 than the first pressing portion 125. Moreover, in this embodiment, in order to satisfy consumer demand for the exterior design, the extension plate 122 is streamlined.

The electrical socket 200 is disposed in the housing assembly 100, and the electrical socket 200 has a slot 210. The width and the height of the opening 130 are greater than the width and the height of the slot 210, and the slot 210 and opening 130 are at least partially overlapped, so that the electrical connector 20 may be inserted into the slot 210 through the opening 130. Moreover, the electrical socket 200 is used for being electrically connected to a main board 40 in a slim laptop computer, so as to transmit the external data to the notebook computer through the external electrical connector 20.

The cover plate 300 is pivotally connected to the bottom plate 121 of the second casing 120, and is located in the second notch 123. Specifically, the cover plate 300 comprises a pivot shaft 310, a plate body 320 and a connection plate 330. The connection plate 330 is connected to both the pivot shaft 310 and the plate body 320. The shape of the plate body 320, similar to the shape of the extension plate 122, is streamlined. The pivot shaft 310 of the cover plate 300 is pivotally connected to the pivot seat 124, so that the cover plate 300 is adapted to pivot relative to the bottom plate 121 between a first position and a second position. The first position is closer to the first casing 110, and the second position is farther away from the first casing 110. When the cover plate 300 is located in the first position, the plate body 320 is adapted to cover the second notch 123 as well as to shield a part of the slot 210.

Moreover, the plate body 320 has an inner wall surface 321. The inner wall surface 321 faces the top plate 111. The plate body 320 comprises a second pressing portion 322 and a fastening portion 323. The second pressing portion 322 is located on the inner wall surface 321, and the pivot seat 124 is located between the first pressing portion 125 and the second pressing portion 322. The fastening portion 323 is disposed on the inner wall surface 321 of the plate body, and is located on one side, close to the side plate 112, of the inner wall surface 321. Specifically, the fastening portion 323 comprises two fastening blocks 324 and a fastening recess 325. The fastening recess 325 is located between the two fastening blocks 324.

In some embodiments, one side, close to the bottom plate 121, of the inner wall surface 321 of the plate body 320 further comprises a guiding oblique plane 326 and a side surface 327 that are connected to each other. The guiding oblique plane 326 is connected to the inner wall surface 321. The side surface 327 faces the surface 126. When the plate body 320 is located in the first position, a distance is kept between the side surface 327 and the surface 126, and when the plate body 320 pivots relative to the bottom plate 121, a gap is kept between the guiding oblique plane 326 and the surface 126. Therefore, it is ensured that enough space is kept between the plate body 320 and the bottom plate 121 to enable the plate body 320 to pivot relative to the bottom plate 121.

The elastic member 400 in this embodiment is, for example, a torsion spring, but not limited to the disclosure. An intermediate section of the elastic member 400 sleeves the pivot shaft 310, and two opposite ends of the elastic member 400 are respectively connected to the first pressing portion 125 and the second pressing portion 322. In fact, the two opposite ends of the elastic member 400 press against the first pressing portion 125 and the second pressing portion 322 through the elasticity of the elastic member 400, so that the elastic member 400 is affixed to the first pressing portion 125, the pivot shaft 310 and the second pressing portion 322. By means of the elasticity of the elastic member 400, the cover plate 300 is enabled to be located in the first position in a normal state. In other words, by means of the elasticity of the elastic member 400, the cover plate 300 has automatic restoration capability to cover the second notch 123 and shield a part of the slot 210.

Figure 4A:
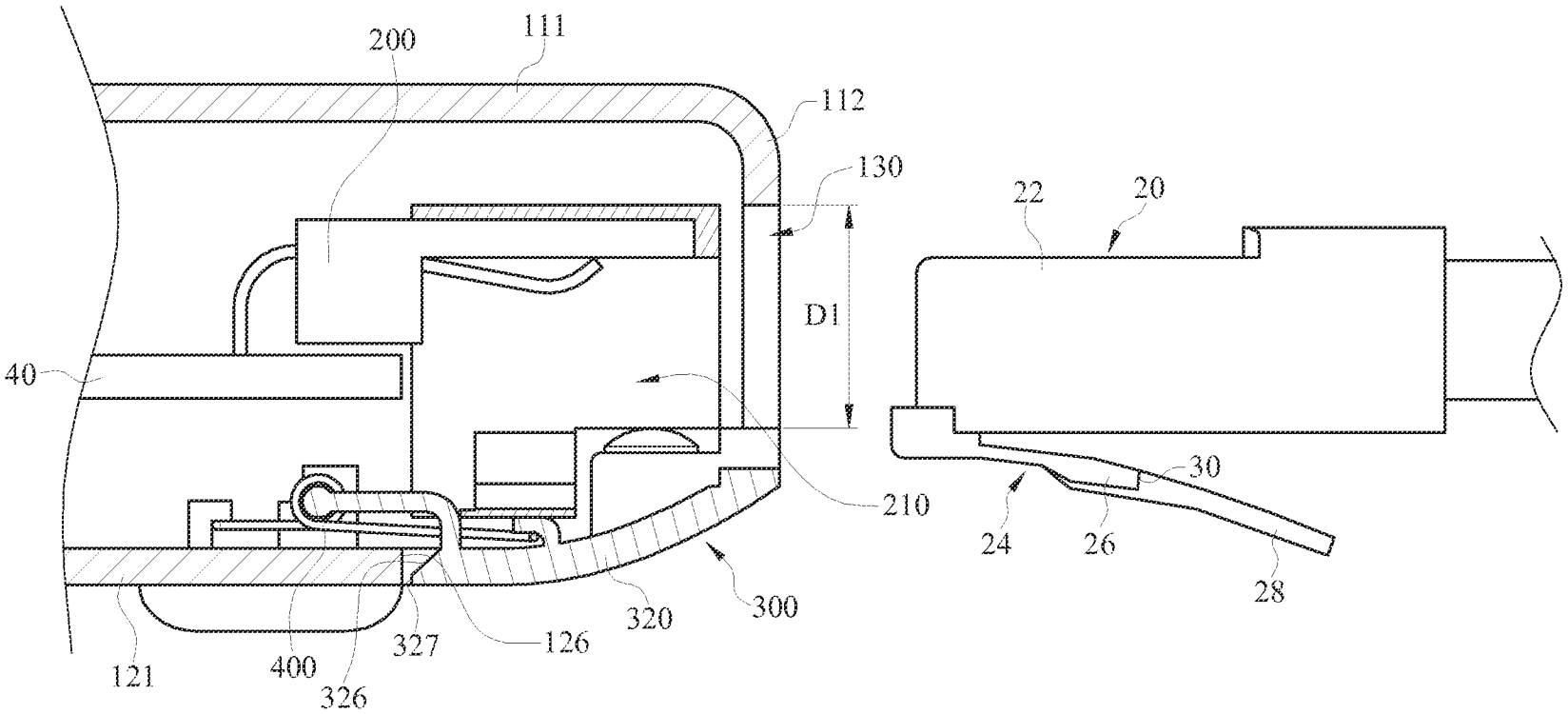
FIGS. 4A to 4C are schematic views of FIG. 1 in operation.
Figure 4B:
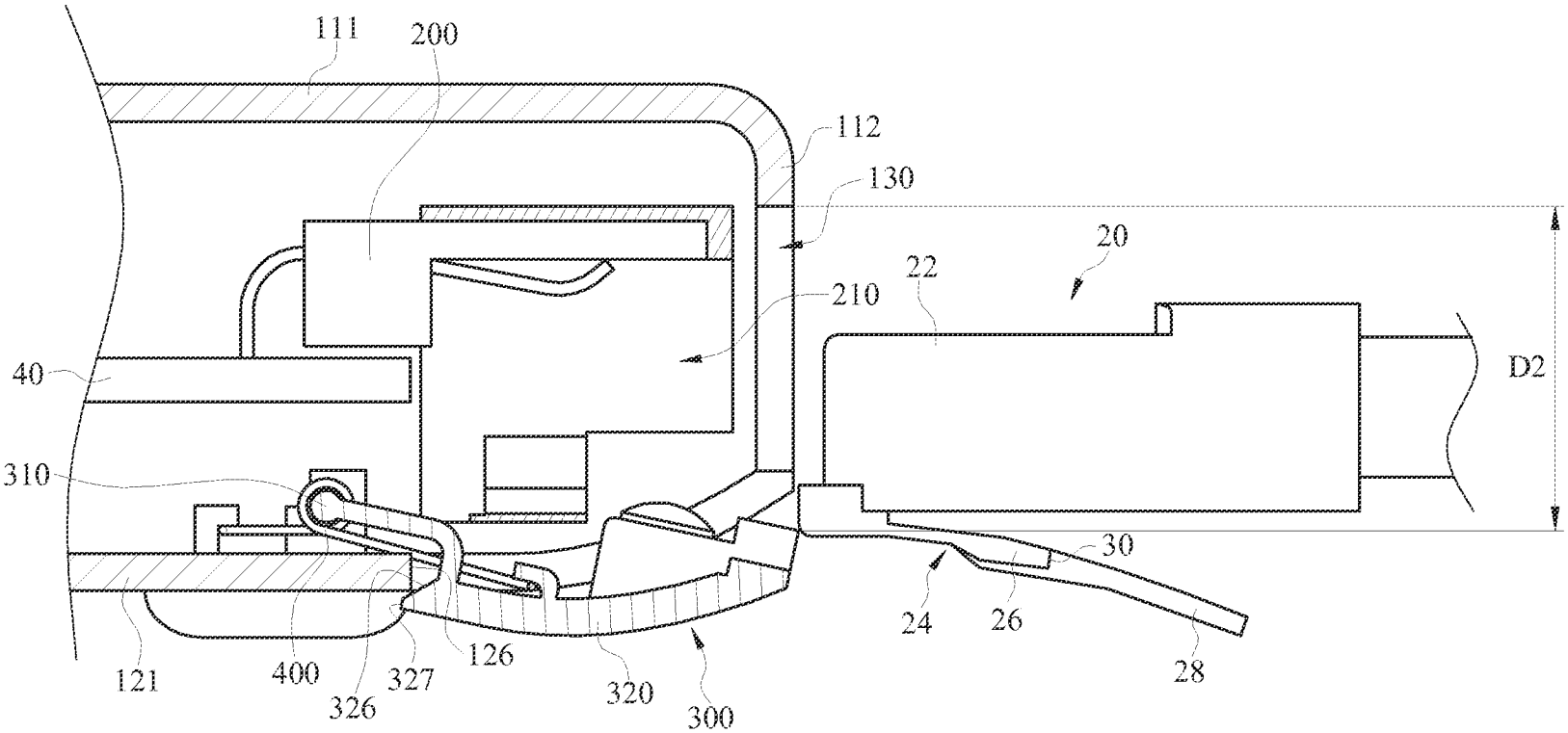
Figure 4C:
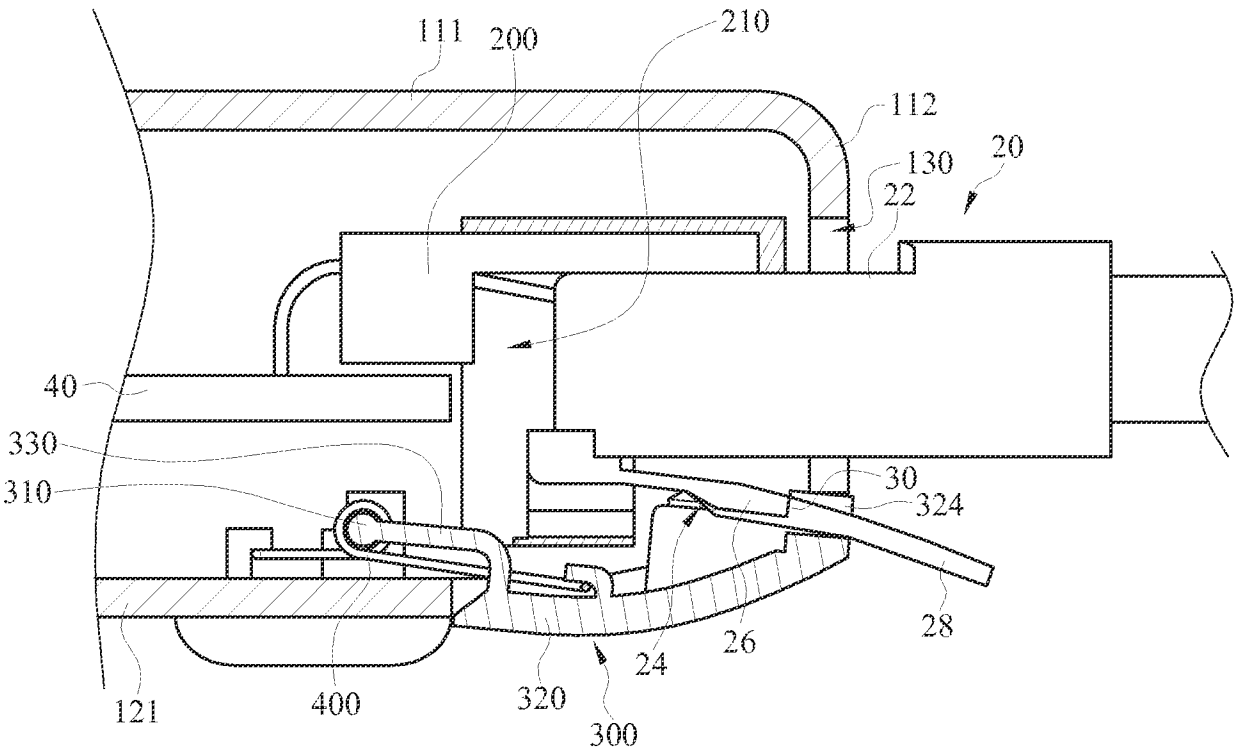

Referring to FIGS. 4A to 4C, FIG. 4A to FIG. 4C are schematic views of FIG. 1 in operation. First, referring to FIG. 4A, when the portable electronic device 10 is not in operation, the plate body 320 is pressed by the elastic member 400 to be located in the first position. At this time, the second notch 123 is covered, and a part of the area of the opening 130 is shielded, so that the opening 130 keeps a smaller gap D1, thereby maintaining the exterior of the housing assembly 100. When the electrical connector 20 is required to be inserted into the electrical socket 200, referring to FIG. 4B, the plate body 320 is pulled downwards first, so that the plate body 320 pivots in the direction leaving the top plate 111, so as to obtain an expanded gap D2 of the opening 130, thereby fully exposing the entire slot 210. Finally, referring to in FIG. 4C, the electrical connector 20 is completely inserted into the electrical socket 200 via the opening 130, so that the cover plate 300 is pressed by the elastic member 400 to restore to the second position. Specifically, the plate body 320 is pressed by the elastic member 400 to move closer to the electrical connector 20, so that the releasing section 28 of the electrical connector 20 is located in the fastening recess 325, and the two fastening blocks 324 of the plate body 320 respectively fasten the two fastening surfaces 30, so as to prevent the electrical connector 20 from exiting by the electrical socket 200.

According to the portable electronic device disclosed in this disclosure, the plate body is pivotally connected to the bottom plate in order to help adjust the size of the opening. When the portable electronic device is not in operation, the plate body is pressed by the elastic member to reduce the size of the opening, and when the portable electronic device is in operation, the plate body is pulled downwards to expand the size of the opening, thereby exposing the entire slot, so that the electrical connector can be inserted into the slot. Therefore, the design achieves both the extension performance and exterior of the electronic device.

Moreover, when the electrical connector is not inserted into the slot, the plate body is pushed by the elastic member and restores to the first position automatically. When the electrical connector is inserted into the slot, the plate body is pushed by the elastic member to restore the second position automatically so that the fastening portion fastens the electrical connector.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to activate others skilled in the art to utilize the disclosure and various embodiments and with various modifications as are suited to the particular use contemplated. Alternative embodiments will become apparent to those skilled in the art to which the disclosure pertains without departing from its spirit and scope. Accordingly, the scope of the disclosure is defined by the appended claims rather than the foregoing description and the exemplary embodiments described therein.

What is claimed is:

1. A portable electronic device, for inserting and connecting an electrical connector, comprising:

a housing assembly;

an electrical socket disposed in the housing assembly, the electrical socket having a slot, the slot being used for inserting into and connecting to the electrical connector;

a cover plate pivotally connected to the housing assembly, the cover plate being adapted to pivot relative to the housing assembly between a first position and a second position; wherein when the cover plate is located in the second position, the cover plate and the housing assembly forming an opening, the opening being in direct connection with the slot, and wherein when the cover plate is located in the first position, the cover plate covers a part of the area of the opening and shields a part of the electrical socket; and an elastic member having one end connected to the housing assembly and the other end connected to the cover plate, and the elastic member adapted to make the cover plate to be located in the first position in a normal state;

wherein, when the cover plate is pressed by the electrical connector, the cover plate pivots to the second position for inserting the electrical connector into the slot, and wherein when the electrical connector is exited from the slot, the cover plate is pushed by the elastic member to pivot to the first position.

2. The portable electronic device according to claim 1, wherein the housing assembly comprises a first casing and a second casing, the first casing is mounted on the second casing, the first casing has a first notch, the second casing has a second notch, the cover plate is pivotally connected to the second casing, and is located in the second notch; when the cover plate is located in the second position, the cover plate and the first casing form the opening, and when the cover plate is located in the first position, the cover plate covers a part of the area of the opening and exposes a part of the second notch.

3. The portable electronic device according to claim 2, wherein the first casing comprises a top plate and a side plate connected to one side of the top plate, the second casing comprises a bottom plate and an extension plate, the extension plate is connected to one side of the bottom plate, the first casing is mounted on the second casing to make the side plate press against the extension plate, and the cover plate is pivotally connected to the bottom plate.

4. The portable electronic device according to claim 3, wherein the cover plate comprises a pivot shaft, the bottom plate has a pivot seat adjacent to the second notch, the cover plate is located at the second notch, the pivot shaft of the cover plate is pivotally connected to the pivot seat, and the cover plate is adapted to pivot relative to the bottom plate.

5. The portable electronic device according to claim 4, wherein the cover plate comprises a plate body and a connection plate, and the connection plate is connected to both the pivot shaft and the plate body.

6. The portable electronic device according to claim 5, wherein the bottom plate comprises a first pressing portion, the plate body comprises a second pressing portion, the pivot seat is located between the first pressing portion and the second pressing portion, the elastic member sleeves the pivot shaft, one end of the elastic member is connected to the first pressing portion, and the other end of the elastic member is connected to the second pressing portion.

7. The portable electronic device according to claim 6, wherein the plate body has an inner wall surface, the inner wall surface faces the top plate, the plate body comprises a fastening portion, the fastening portion is disposed on the inner wall surface of the plate body, and is located on one side, close to the side plate, of the inner wall surface, and when the electrical connector is inserted into the slot, the plate body is pushed by the elastic member to pivot towards the top plate so that the fastening portion fastens the electrical connector.

8. The portable electronic device according to claim 7, wherein the electrical connector comprises a connecting body and an elastic piece, the elastic piece has a fastening section and a releasing section that are connected to each other, the fastening section is connected to the connecting body, one side of the fastening section has two fastening surfaces, the releasing section is located between the two fastening surfaces, the fastening portion comprises two fastening blocks and a fastening recess, the fastening recess is located between the two fastening blocks, and when the electrical connector is inserted into the slot, the plate body is pushed by the elastic member to pivot towards the top plate, so that the two fastening blocks are engaged with the two fastening surfaces, and a part of the releasing section is located in the fastening recess.

9. The portable electronic device according to claim 7, wherein one side edge, close to the bottom plate, of the inner wall surface has a guiding oblique plane, the second casing has a surface forming the second notch, and when the plate body is pivoted relative to the bottom plate, a gap is kept between edges of the guiding oblique plane and the surface.

10. The portable electronic device according to claim 7, wherein the inner wall surface has a side surface close to the bottom plate, the second casing has a surface forming a part of the second notch, and when the plate body is located in the first position, the surface of the second casing faces the side surface, and a distance is kept between the surface and the side surface.

* * * * *